US005445245A

United States Patent [19]

Ketoviita

[11] Patent Number: 5,445,245

[45] Date of Patent: Aug. 29, 1995

[54] SYSTEM FOR REMOTE CONTROL OF ELEVATOR EQUIPMENT

[75] Inventor: Seppo Ketoviita, Hyvinkää, Finland

[73] Assignee: Kone Oy, Helsinki, Finland

[21] Appl. No.: 165,597

[22] Filed: Dec. 13, 1993

[30] Foreign Application Priority Data

Dec. 22, 1992 [FI] Finland ..... F1925842

[51] Int. Cl.[6] ..... B66B 3/00

[52] U.S. Cl. ..... 187/391; 187/247

[58] Field of Search ..... 187/139, 100, 101, 130, 187/140, 391, 393, 247, 390

[56] References Cited

U.S. PATENT DOCUMENTS

| | | | |
|---|---|---|---|
| 3,973,648 | 8/1976 | Hummert et al. | 187/29 R |
| 4,431,086 | 2/1984 | Moser et al. | 187/29 |
| 4,697,243 | 9/1987 | Moore et al. | 364/513 |
| 4,771,865 | 9/1988 | Hinderling | 187/130 |
| 4,823,914 | 4/1989 | McKinney et al. | 187/133 |
| 5,007,506 | 4/1991 | Suzuki et al. | 187/101 |
| 5,064,026 | 11/1991 | Nagata et al. | 187/130 |
| 5,131,508 | 7/1992 | Suzuki | 187/132 |

FOREIGN PATENT DOCUMENTS

| | | | |
|---|---|---|---|
| 2226428 | 6/1990 | United Kingdom | 187/139 |

OTHER PUBLICATIONS

Patent Abstracts of Japan, vol. 17, No. 2 (M-1348) 5 Jan. 1993 & JP-A-42 035 881 (Toshiba Corp) 24 Aug. 1992. *abstract*.

Patent Abstracts of Japan, vol. 16, No. 181 (M-1242) 30 Apr. 1992 & JP-A-40 020 465 (Toshiba Corp) 24 Jan. 1992. *abstract*.

Patent Abstracts of Japan, vol. 14, No. 224 (M-0972) 11 May 1990 & JP-A-20 056 391 (Mitsubishi Electric Corp) 26 Feb. 1990. *abstract*.

*Primary Examiner*—Thomas M. Dougherty
*Assistant Examiner*—Robert Nappi

[57] ABSTRACT

A system for regional and local supervision and monitoring of elevator equipment, that includes a modular system containing a service center set of equipment and an on-site set of equipment connected to at least one building. Communication between these sets of equipment is implemented using a remote communication link. A connection from an elevator car to a service center and from a service center to an elevator car is provided through the on-site equipment. A connection between an elevator car and a preselected service point can be established by the on-site equipment.

15 Claims, 5 Drawing Sheets

SYSTEM FOR REMOTE CONTROL OF ELEVATOR EQUIPMENT

BACKGROUND OF THE INVENTION

1. Field of the Invention

The present invention relates to a system for regional and local supervision and monitoring of elevator equipment.

2. Description of Related Art

An example of previously known technology is found in U.S. Pat. No. 3,973,648, which presents an apparatus for monitoring elevator groups by means of a central computer and a modem link. The central computer selects an elevator group, which then returns digital data in serial form about events relating to the operation, disturbances and alarms in the elevator group. For communication between the elevator group and the central computer, the apparatus is provided with a hardware interface used for monitoring and transmission.

A drawback with the system is that the data are transmitted in an undecoded form. The central computer must decode the received data and decide whether the decoded information has resulted in service operations. For the transmission of up-to-date data to the central computer, rented communication lines have to be reserved for a long time and a lot of computer time is required. Another drawback is that the central computer calls the elevator groups to be monitored. Therefore, the information is not obtained at the instant it is generated but only after a delay depending on the inquiry period. Besides, at least during periods of a low traffic volume, it is possible that no events are registered.

For the installation of the car equipment, several car cable wires between the elevator car and the telephone interface unit placed in the machine room are needed for voltage supply, signal light control, monitoring of switches and push buttons and for the control of the speaker and microphone. Most car cables, especially those of old elevators, do not have a sufficient number of extra wires in well-protected conductor pairs. It is necessary to install a new car cable which meets the requirements of the connection.

SUMMARY OF INVENTION

In the solution according to the present invention, this is impelemented by using a procedure in which the data transmission between the machine room and the elevator car is effected by means of only one conductor pair, which is used for the transmission of both the electricity needed by the car unit and the control and audio signals. The system has a high immunity to noise and requires no special cables, the wires in the existing car cable can be used for the data transmission. The remote monitoring hardware of the elevator generally consists of a modem/control unit which is placed in the machine room and reacts to the car alarm button being pressed, calls a service point and establishes a voice connection between the passenger who made the alarm and the serviceman. In some cases, several elevators can be connected to the same monitoring unit if they have a common machine room.

Remote Elevator Monitoring System:

The REM system is divided into three levels. Level I comprises the monitoring and voice connection equipment for the car alarm button; level II comprises level I+filtering of wanton use, a system for monitoring elevator failures and other vital elevator events. Level III=level II+high-level elevator monitoring system. The REM system comprises two subsystems: service centre equipment placed in the service centre, and on-site equipment placed at the site of installation in the buildings where elevators are to be monitored. Communication between the on-site and service centre equipments occurs via the common telephone network. One receiver can serve hundreds of on-site equipments.

The invention provides the following advantages:

- Replaces the new car cable and its installation that would otherwise be needed in most cases.
- Requires no expensive special cable.
- The control/detection of all functions associated with the car, alarm button, signal lights, switches, speakers and microphone, is implemented locally, without long wiring.
- All communication occurs via a single conductor pair, no additional cables are needed when new car unit functions are introduced.
- The system has a very high immunity to noise, especially common-mode type noise, and therefore does not require the use of a protected special cable.
- The required power is supplied from the machine room, so no separate power supply is needed. The whole system, including the voice connection, works even during a power failure.

DESCRIPTION OF PREFERRED EMBODIMENTS

Figure 1:
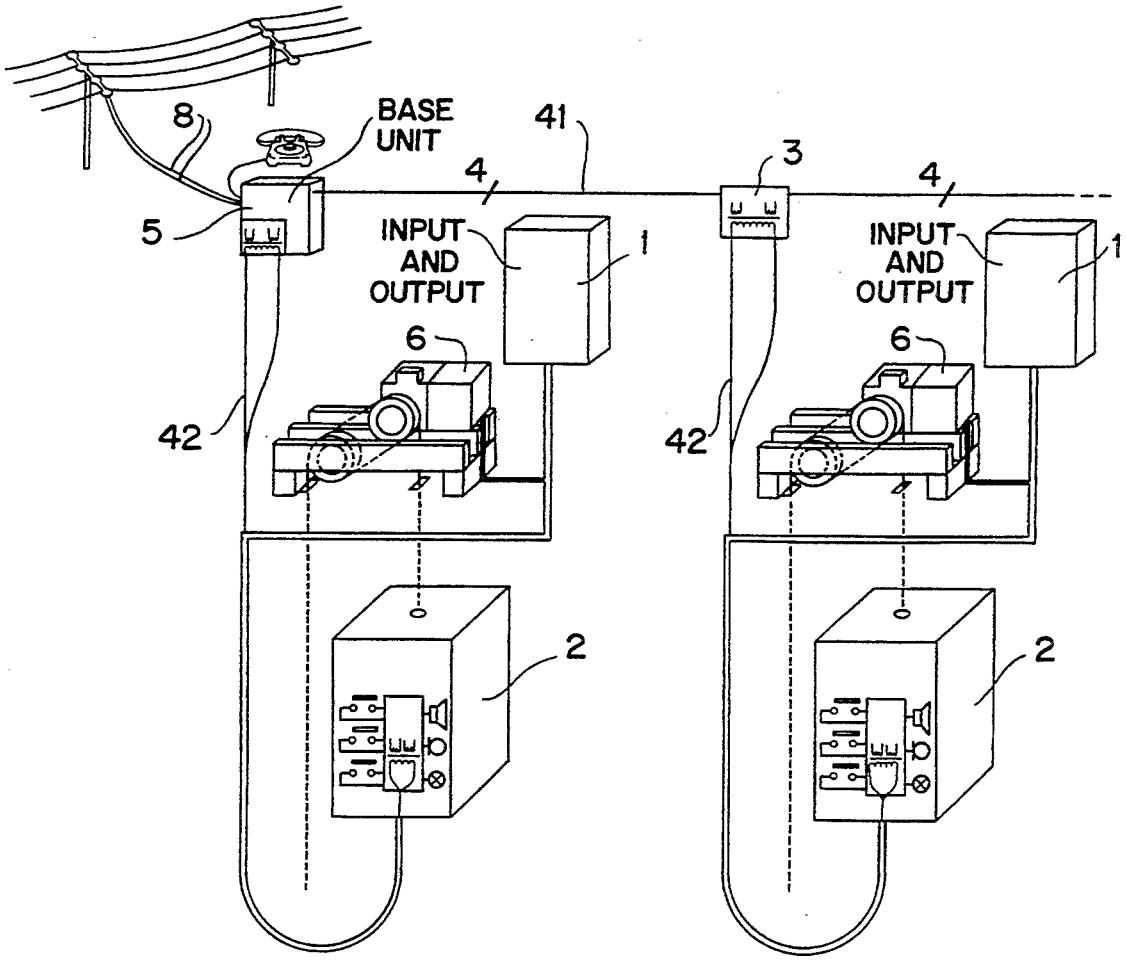
FIG. 1 illustrates the on-site equipment.

FIG. 1 presents the on-site equipment. It consists of four main parts, one of which is the base unit 5, depicted in detail in FIG. 2. It has a few indicator devices showing the status of the equipment. An optional accessory is a keypad/display, which can be used to indicate device status in detail or for configuration. A car interface for the first car is included in the base unit 5. Normally, the base unit 5 is placed in the machine room of the elevator.

A car interface unit 3 is needed when several car units 2 are connected to the base unit 5. The connections between the base unit 5 and the car interface units 3 are implemented using a four-wire cable 41. The car unit 2 is placed in the elevator car. It contains the electronics required for the audio and data communication and receives its power via a 2-wire connection 42. Element 6 is a control unit for each elevator.

An I/O unit 1 is normally placed in the elevator machine room. The I/O unit 1 has digital inputs and outputs to be used in a level II system. Indicators show the status of each input and output. A car interface unit 3 for connecting a car unit 2 is integrated in the I/O unit. As an option, the equipment can be provided with a keypad/display, which is used to show status details or to configure the device. The I/O unit I is also provided with indicators for simple status data:

communication failure
technical failure not reported
technical failure
emergency call (input)
valid emergency call (output)

and if an auxiliary power supply has been installed:

power supply (main or battery)
battery voltage low

Optionally, the I/O unit I may also be connected to an intelligent keypad/display when the I/O unit I is not mounted in the same location (machine room) as the base unit. The keypad/display is operated via menus. All texts are in the local language.

The alarm button may be either a zero potential contact or an alarm button in an existing alarm bell circuit. By selection, it can be a NC (normally closed) or a NO (normally open) type contact. The alarm bell circuit may be supplied with a voltage of 6–48 VAC/DC. For the alarm and listened-to lights, efficient LED types with a max. current consumption of 2 mA must be used. Each LED is connected to the car unit with 2 wires. Optionally, one or two relays can be mounted for the connection of lamps requiring more current, supplied from an external power source. The loudspeaker and microphone to be used for voice communication are delivered with the car unit 2.

Figure 2:
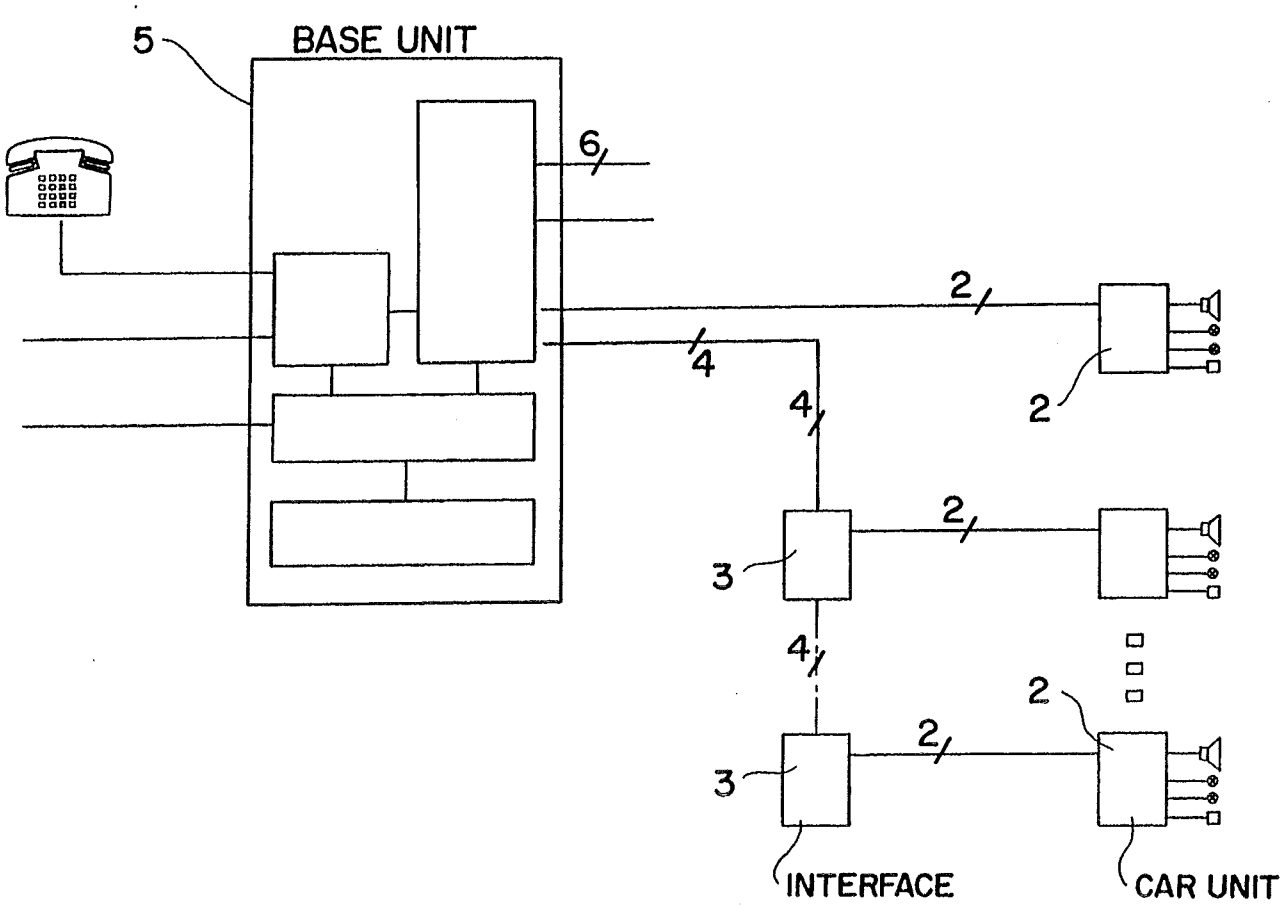
FIG. 2 illustrates the operation of the base unit.

FIG. 2 illustrates the operation of the base unit 5. Each base unit 5 can handle 8 elevators in one building or groups of buildings. The on-site equipment allows the use of a 4-wire cable of a length of 1000 m between the base unit and the car interface units 3 (or I/O units 1). The 2-wire cable between the car unit 2 and the elevator machine room unit (base unit 5, car interface unit 3 or I/O unit 1) may be up to 300 m long. The on-site equipment and the receiver 20 have a back-up power supply allowing at least 8 hours of stand-by operation. The car unit 2 contains a user interface, comprising a push button, two lamps (LEDs), one microphone and one loudspeaker. The push button is used to start an emergency call, one of the lamps indicates the status of the emergency call and the other the 'car listened to' status. The microphone and the loudspeaker are used for voice communication after a connection to the service centre has been established. The 'car listened to' light is lit when the microphone is on. The base unit 5 has indicators for simple status data:

power supply (main or battery)
telephone line failure
battery voltage low
call in progress
system failure (e.g. in the internal communication network).

Optionally, the base unit 5 may also be connected to an intelligent keypad/display for the input of additional status information and for configuration of the on-site equipment. For data communication between the base unit 5 and the intelligent keypad/display, the same protocol is used as on the telephone line.

Figure 3:
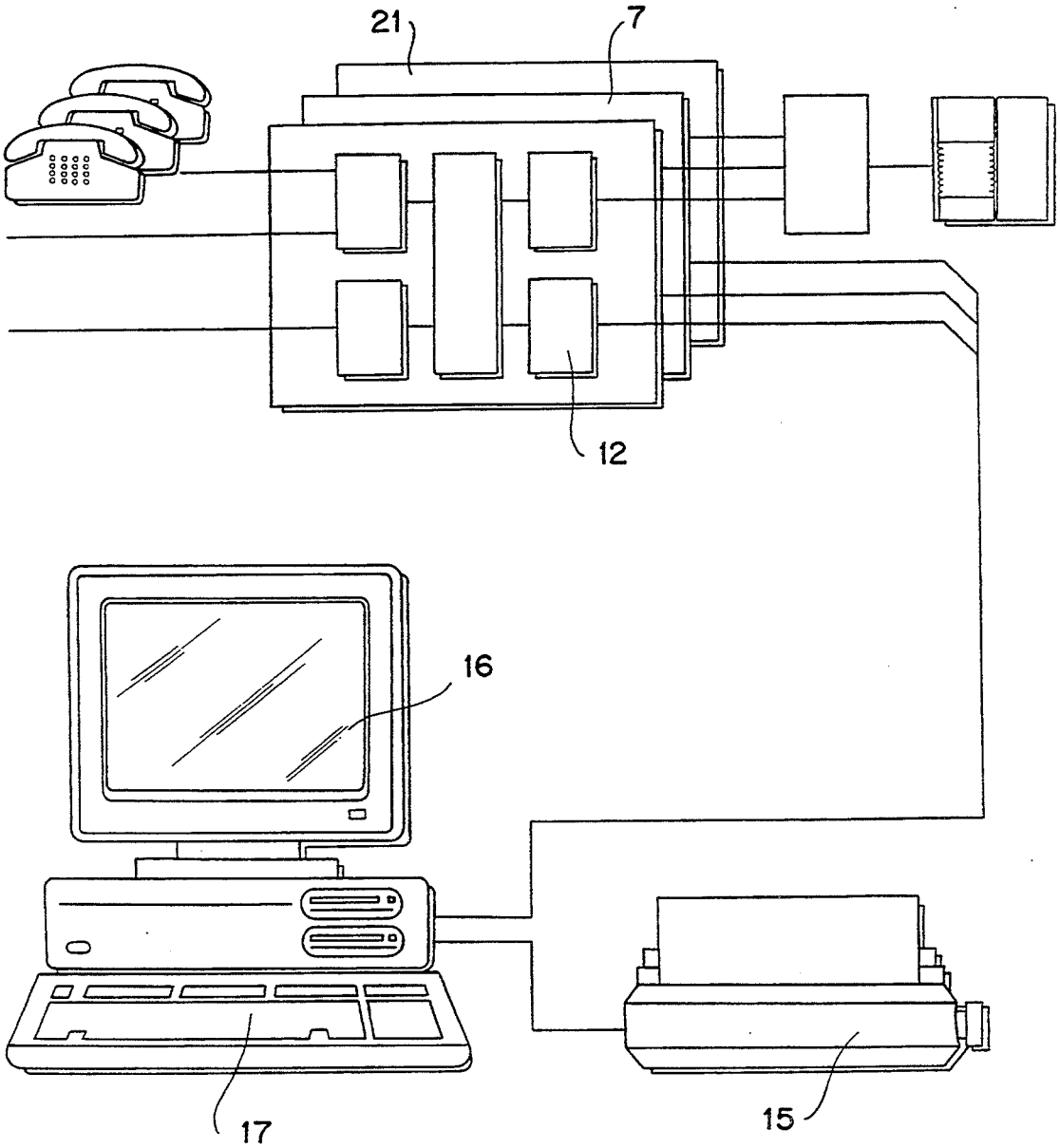
FIG. 3 illustrates the service centre equipment.

FIG. 3 presents the service centre equipment. The receiver 20 is regarded as a normal office machine and is placed on a table or in a cabinet. The receiver 20 is a closed unit with two cables, one of which connects it to the telephone network, the other to the electrical network. The cabinet can accommodate a battery.

Moreover, the receiver 20 is provided with interfaces for the connection of a log printer 14, a computer 16 and an operator's telephone. The computer 16 has a testing program used for the installation. After the installation has been compeleted, the normal operating program can be started. The servicing and maintenance of the on-site equipment is taken care of by the normal elevator service personnel. The on-site equipment must be so designed that it requires no servicing except for the following checks:

Testing of battery condition and change of battery when necessary.
Control of transmission (data and voice) by testing each push button of the elevator car.
Visual inspection of the equipment.

The receiver 20 has its own internal backup power supply allowing 8 hours of operation without main supply power. The receiver 20 is provided with a switch and a lamp indicating whether the service centre receiver 20 is unmanned.

The receiver 20 has automatic testing functions and corresponding visual indicators for the following purposes:

mains or battery supply
battery voltage low
telephone line failure
internal failure
PC not connected
log printer not connected In stand-by mode, all incoming calls together with the text information received and the time of reception are printed out via the log printer 14. The same printer can be used as a common output device for max. four receivers 20 by using an external printer sharing device. The printer and the sharing device must be powered from a separate backup supply. Each incoming call is saved in a file on a hard disk in the computer 16 and printed out via a printer 15 (if connected). Each call is associated with a time and a status flag indicating whether the message has been printed out or not. The various types of calls can be selected for display. The selected incoming calls are displayed on the monitor screen with all the text information received and with the information added by the service centre, including the time of reception. The address data can be omitted if desired. When several emergency calls are received from the same base unit 5, it is possible to select one of these for normal voice communication, or to select wireless transmission of a voice message to all the elevators from which an emergency call has been received. The system also comprises a function which triggers a call back from the on-site equipment. When a call back received from a given on-site equipment is detected, various commands can be selected from a menu:

a) to obtain status data
b) for servicing/testing purposes
c) for configuration of all parameters of the on-site equipment
d) to establish a voice connection
e) for remote control of the I/O unit outputs.

Figure 4:
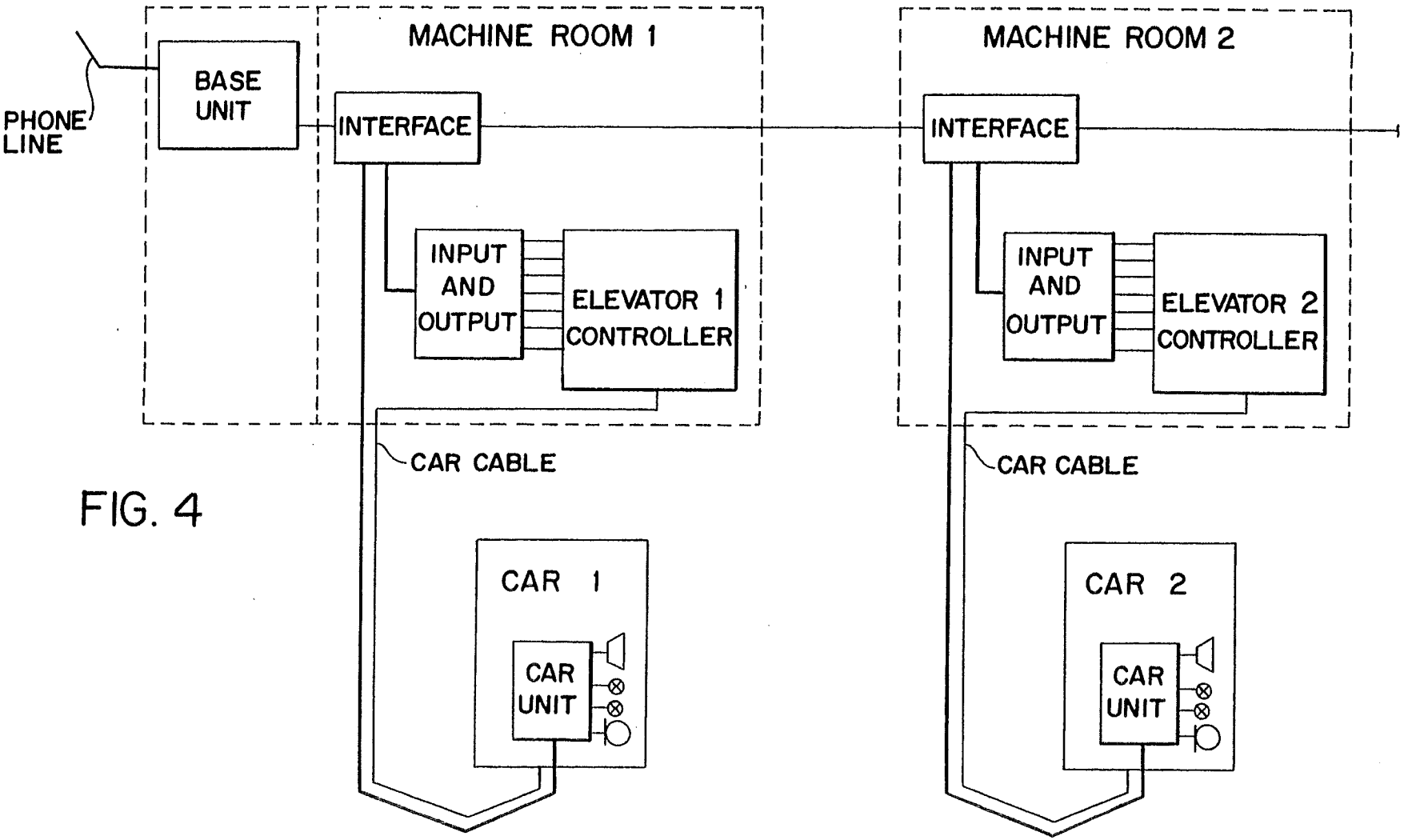
FIG. 4 illustrates the on-site equipment and elevator machine rooms.
Figure 5:
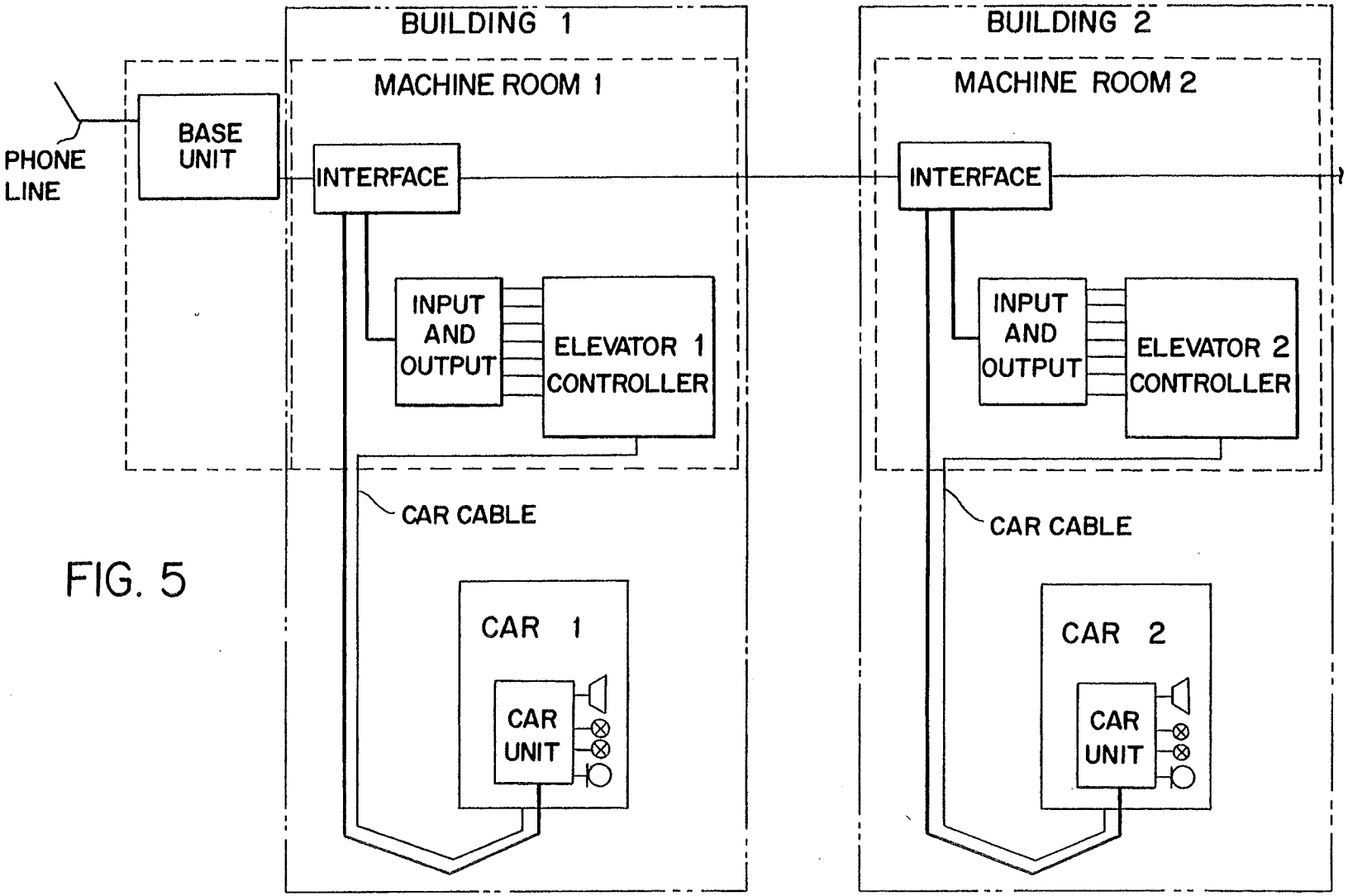
FIG. 5 illustrates the elevator cars of FIG. 4 in separate buildings. Each of the elements is shown in labelled box form for ease of understanding.

FIG. 4 illustrates two elevator cars and there associated equipment with the base unit. Each of the elements is shown in labelled box form for ease of understanding.

Functions of the REM system:

Each elevator has its own identification code which is communicated in connection with each call. An on-site equipment can send a message to several service centres: to the main service centre, at least two back-up service centres, to a programming service centre and also to an ordinary telephone. The primary function of the REM system is to report an emergency situation. An emergency situation is created by trapped passengers by pressing the alarm button in the elevator car. The system establishes a voice connection between the trapped passengers and the service centre operator.

Another function of the system is to report elevator malfunctions and service needs. If an immediate service visit is not required, the need is reported in connection with a routine call. This function is included in level II equipment.

To maintain a high safety standard at each site of installation, the system performs an automatic self-test and reports all disturbances found in its operation. The self-test report comprises a battery check and the absence of mains power.

Each on-site equipment in the system sends regular routine calls to the service centre. With the aid of this routine call, the service centre monitors the on-site equipment. If the service centre does not receive a routine call regularly, it can initiate a service visit to the site. This regular connection is also used for the reporting of low-priority service needs and for the transfer of certain parameters from the service centre to the on-site equipment. The service centre may call an on-site equipment to establish a connection for data communication for the setting of parameters or for the collection of data from the installation in question. A voice connection can be created as well.

A copy call is a copy of a message previously communicated to another service centre.

The on-site equipment is used by trapped passengers and elevator service engineers who use the on-site equipment when servicing the elevators. The service centre equipment is used by service centre operators.

Operation of the on-site equipment:

Automatic calling sequence

For each type of call, the base unit 5 establishes a telephone connection to the service centre according to a phone number list. The first part of the data transmission from the on-site equipment consists of the identification code of the equipment and the call type. The call type defines the data to be transmitted. It should be possible to send several messages without interrupting the telephone connection. The service centre will then answer depending on the call type.

Examples of call types:

1. emergency call with voice connection
2. technical/system failure call
3. service need call
4. routine call
5. call back
6. copy call If 'routine call' is enabled, 'service need calls' will be reported in connection with the next routine call. If a call is an emergency call or a technical call, the service centre answer will indicate whether the centre is manned or not. If unmanned, the on-site equipment will call the next phone number in the list. If manned, a complete emergency message will be transmitted. In the case of an emergency call, voice communication will be initiated, too. The voice part of an emergency call can also be transmitted to a normal telephone. This can be done in two ways. 1) The service centre is called first. A message received from the service centre contains the phone number to be called; or 2) The normal telephone is called first and, after a conversation, a message is sent to the service centre. Other types of calls are logged by the service centre equipment, to be handled by the operator immediately or later. If the purpose of a call back is to establish a connection to a service centre not in the phone number list, the new call-back phone number must first be down-loaded from the service centre to the on-site equipment before a new call back can be initiated. Generally, the messages sent between the on-site equipment and the service centre include a handshake to ensure that no message will be lost. Error detection is used in the transmission of all messages to ensure that correct information is sent.

Initiation of an emergency call

Pressing the alarm button in the elevator car is the normal way to initiate an emergency call. To avoid false alarms, the alarm button has to be pressed for a certain time before an emergency call is initiated. This time period is called the 'filter time'. If the alarm button is pressed and released again for a short period, the on-time is accumulated. If the button has been released for a period longer than the 'filter time', the accumulated value is reset. The time filtering is the only possible filtering in a level I system. In level II systems there are options to be configured:

a) Filtering based on digital inputs (I/O unit). Depending on one or more digital inputs, the initiation of an emergency call is only allowed if the elevator car is in an abnormal condition. The programmed 'filter time' is still valid. To allow emergency calls even when the car has stopped in a normal position, pressing the alarm button will intitiate an emergency call after a 'filter time 2' period.

b) With automatic car calls (I/O unit) outputs to the elevator controller. One or two outputs can be configured for automatic car calls. When the alarm button in a car has been activated, the car call outputs are first activated in sequence to try if it is possible to bring the car to another position. If the elevator car does not respond by moving and opening the door, an emergency call will be initiated automatically. This automatic car call function is to be configured according to national regulations.

In a level II system, a special 'voice test call' is initiated if the status 'service engineer on site' exists.

Technical alarm and service call

A call can be initiated by an elevator failure or by an internal fault condition, or by internal counters or timers. In a level I system, technical alarm calls are intitiated by internal failures, including 'battery voltage low', 'mains missing during a (programmable) period' and 'no response from configured car units'. In a level II system, technical alarm calls can also be initiated by using monitoring functions based on signals from the elevator controller connected to an I/O unit. Such functions can be configured individually for each elevator. The conditions are to be programmed by using a combination of softtypes (predefined behavior of a certain input type) and logical functions. The configuration possibilities include timer functions and latches. Each input can be programmed with one of the sofftypes in order to achieve the desired reaction. For each input a text string can also be allocated, for easy identification.

One special function could be 'automatic car calls'. One or two outputs are configured and connected to the elevator controller. When 'automatic car call' has been activated, the car call outputs will be activated in sequence to see if it is possible to bring the car to another position. This function could also be remotely controlled from the service centre.

The timers can be programmed for periods ranging from a second to an hour. If a technical failure occurs, it should be possible to delay the initiation of a technical alarm call. If the car has been taken in use after the reporting of a technical failure, a cancellation report should be sent immediately.

In a level II system, service calls are initiated by elevator event counters registering 1) the number of starts, 2) the number of door closings, 3) the total running time. If car position data is available, a counter for each landing door could be configured as well.

The equipment can be configured to generate a copy call to the main service centre for each message sent to a backup service centre. The phone number list holds at least six phone numbers to be used for the different types of calls.

Phone number 'A' is for the main service centre of the area.

Phone number 'B' and 'C' are back-up numbers for 'A'.

Phone number 'D' is for the programming centre, and could be the same as 'A'.

Phone number 'E' is for routine calls.

Phone number 'F' is a normal telephone number.

Each phone number consists of max. 24 digits, including the coding for dialling, e.g. 'wait for dial tone', 'change to touch-tone dialling' or 'change to pulse dialling'. Automatic adjustment of time is included in the routine calls, synchronizing the automatic time/date setting function.

*1)If 'the service centre is unmanned' the next number in the sequence is selected.
If 'the service centre is busy', try N times calling the same phone number. After N failed attempts, go on to the next number.
If 'no answer from the service centre', select the next number.
If 'communication with the service centre in progress', try N times calling the same phone number

*2) Normally a call back will go to the programming centre, but when an emergency alarm has not yet been reset and a call-back trigger is detected, the on-site equipment will send a new emergency call. This function is designed to ensure that a message from the service centre can come through to the trapped passenger.

*3) If 'copy call' is selected, a copy of the message sent to a backup service centre will be sent to phone number 'A' (if possible).

*4) If 'the service centre is busy', try again after M minutes. The routine call phone number can be configured so as to allow the use of a special number. The purpose of this configuring is to make sure that the telephone line A (at the same service centre) is available for emergency calls.

*5) If routine call is enabled, low-priority service calls will be reported in connection with the next routine call.

*6) The possibility to make a 'voice only' call to a normal telephone is to be included.

The above-mentioned calling sequence and functions may be overruled by local regulations. The system has a built-in number checking feature to filter out certain phone numbers, like 000 or 999.

The routine call includes an automatic time/date setting function to synchronize the on-site real-time clock with the service centre computer time/date. This automatic time adjustment also includes a feature allowing time zone differences between the service centre and the on-site equipment. Included in the on-site equipment are parameters to be configured for automatic adjusting of summer/winter time change independently of the routine call time.

The base unit 5 has visual indicators for faults and status. The condition of the battery is tested every 15 seconds. If a test fails, a service call will be initiated. A complete capacity test of the battery is not included. An automatic routine call is performed at a programmed time and interval. This function can be enabled/disabled. Information about service needs is automatically transmitted when the routine call takes place. The routine call procedure must be as short as possible to minimize the load on the service centre receivers and the cost of the communication.

All programmable functions have default values in order to minimize the configuring of the individual on-site equipment. All time-dependent events, together with the time and date, are registered in an event log. The logged information can be retrieved locally or from a service centre.

The event log holds the information about events in a FIFO (First-In-First-Out) buffer. Memory for at least 50 events should be reserved. All types of calls made to a service centre are logged in the event log. Also events related to the base unit 5 are logged, i.e. telephone line failures, 2-wire bus failures and base unit self-test failures. Each event in the event log has a status field holding information about whether it has been successfully reported, is not reported or is not to be reported. The same event repeated at short intervals should not be allowed to fill the event log, but either be 'counted up' or not registered until the previous event has been reset. The status log maintains all status signals, e g 'emergency call', 'service engineer on site', 'elevator out of use', or 'service need'.

The status of all failures/alarms/service needs must be 'reset' when the service or check has been performed. This status log also includes event counter values relating to the previous service visit.

Text information about elevator ID, address and car position is transmitted with each call. Each elevator has its own programmable ID and address information. The ID code contains up to 20 characters, the address up to 40 characters. The address part of the message can optionally be omitted. The message also includes the reason for the call and the number of trials needed to come through to the receiving receiver 20. The car position is reported on the basis of digital inputs if available (only for level II systems).

All parameters for the on-site equipment can be programmed/configured at the factory and downloaded from the service centre computer via the receiver, or they can be programmed locally. When programming, whether locally or remotely, a password must be used for access to the configuration tables. The password can be changed by authorized personnel. The call-back trigger function is initiated upon detection of ringing. The no-break power supply should allow at least 8 hours of operation. The on-site equipment is expandable for handling up to 8 cars.

During an emergency call, the passengers trapped in an elevator car are continuously kept informed about the progress of the call to avoid panic. An emergency call in progress is indicated by the ALARM lamp in the calling car and by a sound, e.g. resembling dialling tones, issued via the loudspeaker.

When a voice connection to a service centre or a normal telephone has been established, a speak-mode indicator light is lit, showing that 'the car is supervised' or 'listened to' and that the microphone is connected. In broadcast mode the lamp is off.

Call back with voice is possible as the service centre can always make a voice call to a car, even when the alarm button has not been activated. This possibility has been included mainly for testing purposes. The car unit and its signal lights behave exactly like in the case of an emergency call. To make a voice call to a car, the call-back function must first be triggered. A trapped passenger can repeat an emergency call by re-activating the alarm button.

When broadcast voice mode is selected by the service centre operator, a broadcast voice message will be sent to all cars wehre an emergency call is in progress.

The data communication between the base unit 5 and the service centre is implemented using an open protocol in order to provide maximum itegration possibilities.

In the data communication on the 2-wire line (between base unit and I/O unit), an open protocol must be used to allow the addition of new functions to levels II and III. All the commands can also be transmitted via the telephone line 8.

Via the optional keypad/display, the commands can be issued on-site.

NORMAL FUNCTIONS:
READ alarm status
RESET alarms
READ status of base unit
  mains on/off
  battery voltage too low
  service engineer on site
  telephone line failure
  system failures
READ STATUS of each elevator
  emergency alarm
  technical alarms/failures
  service needs and counter values
  elevator out of service
  service engineer on site
  input status (digital input)
  output status (digital output)
READ LOG
SERVICE FUNCTIONS:
TEST SYSTEM
SET/RESET 'service engineer on site'
SET/RESET 'elevator out of use'
PROGRAMMING FUNCTIONS:
SET time/date
SET time zone parameter
SET summer/winter time change
SET phone numbers
SET routine call parameters
  hour/minute/interval/enable
SET ID of base unit
SET programming log-on code (password)
SET default values
SET copy call on/off
and for each elevator:
SET ID of elevator
SET address of elevator
SET 'filter times'
SET input of softtypes
SET input of text strings
SET output of softtypes
SET service counter limits
  starts, door operations, and operation time Voice call to a normal telephone should also be possible. See section 'phone number list'. It must be possible to select between 1) calling the service centre first to get the phone number and 2) calling the programmed phone number first. In voice mode, commands can be given via the telephone keypad (DTMF). At least one command is necessary for termination of voice mode. Other commands may be necessary, e.g. 'gain control', 'extend voice period', and 'acknowledge voice contact'.

Full duplex communication is to be used in the system. No switch is to be used in the service centre. This also gives the possibility to make a voice call from the on-site equipment to a normal telephone.

There is a maximum call time, because in some countries PTT regulations may require the termination of a call after a certain time.

It should be possible to use the base unit 5 telephone for intercom connections to car units 2. This feature should at least be available in a level II system. Remote control of the ouputs of the I/O unit 1 should be possible in a level II system.

The service centre equipment is normally controlled by means of a computer, using its keyboard and display. The normal mode gives the best possible operator interface and allows a 'customer elevator database' to be integrated in the system. By selection, the log printer can be configured to print all receive messages in normal mode.

The service centre equipment can also be operated in back-up mode. This mode is automatically selected when the computer is not on-line, not running, not connected or not powered. When the equipment is operated in back-up mode, all emergency calls can still be handled and all received messages are printed out on the log printer.

The functions relating to setup/control of the receiver 20 are as follows:
  set/reset receiver
  'unmanned' signal
  test receiver
  read status of receiver In addition, an automatic time/date update function is included.

The functions available to the operator include:
  printing of the complete event log
  printing of certain types of calls, e.g. all routine calls received.

The receiver 20 is provided with a number of indicators showing the status of the equipment, including a sound signal telling the operator when to take action. Voice communication takes place via a telephone head/handset.

All texts in the computer are in the local language. When several alternatives are possible, help facilities and menus are available. Error messages are issued for different types of errors and failures.

The shaft wiring needed to connect the car unit is implemented with two wires by making use of the free conductors in the existing cables. Each on-site equipment can be configured at the factory, by remote control from the service centre, or by using an optional keypad/display, connected either to the base unit 5 or to the I/O units 1.

The base unit 5 is mounted in the machine room close to the elevator control panel. The mounting is to be carried out using max. four screws, without removing any devices from the box. A separate mains supply cable must be provided and all local regulations relating to electrical installations must be observed.

The system is so designed that no ground connection is needed. However, local regulations may require the use of a protective ground connection. All terminals must be screw terminals, clearly marked, easy to find and easy to work on. One or two batteries are to be installed in the base unit.

The car unit 2 is placed on the outside of the elevator car, i.e. on the back of a removable car panel. The car unit is designed for flexible mounting. The printed-circuit board of the car unit is to be mounted with 4 screws. It is provided with separately mounted screw terminals for the connection of a loudspeaker, microphone, LEDs, alarm button, and a 2-wire bus (from the base unit).

When the on-site equipment is to be started up for the first time, an installation program specially designed for this purpose must be executed. To handle this program, the optional keypad/display may be connected to the base unit 5, or the program may be executed under remote control from the service centre. The installation program is divided into two parts:

Part 1: Parameter settings

Part 2: System testing

After the above has been carried out, the system is ready for operation.

It is obvious to a person skilled in the art that different embodiments of the invention are not restricted to the example described above, but that they may instead be varied within the scope of the following claims.

I claim:

1. A modular system for regional and local supervision and monitoring of elevator equipment, comprising:

service equipment at a service center;

site equipment including a base unit at a site including means for operatively connecting the base unit to one to eight elevator cars;

means for communicating between the service and site equipment including a phone number list from which a phone number of the service center containing the service equipment is selected;

an elevator car unit operatively connected to the base unit for supplying audio and data communication; and a machine room for each elevator, said machine room containing an input and output device for a single elevator with each input and output device connected to a single common base unit.

2. The system according to claim 1 further including means for selecting a call sequence of the numbers in said phone list, so that a specific call sequence related to the numbers in the phone list can be configured.

3. The system according to claim 1, wherein said base unit includes means for sending routine calls to the service equipment.

4. The system according to claim 3, wherein the base unit includes indicators for indicating the status of the system, the status of the system transmitted by data.

5. The system according to claim 4, wherein the base unit includes means for inputting data.

6. The system according to claim 3, wherein said base unit includes means for sending a plurality of communications; and said service equipment includes means for selecting at least one of said the communications and selecting commands for the site equipment from a menu.

7. The system according to claim 6, wherein said service center equipment service includes means for receiving audio and text data.

8. The system of claim 3, wherein said site equipment further includes an interface unit operatively connected to the base unit so that several elevator cars can be connected to the base unit.

9. The system according to claim 3, wherein said site equipment includes an input and output device operatively connected to the base unit.

10. The system according to claim 9, wherein said input and output device includes indicators for providing status data.

11. The system of claim 9, wherein said input and output device includes indicators for providing information related to power supplies.

12. The system of claim 11, wherein said input and output device and said base unit are mounted in different locations and said input and output device includes a keypad display operated by menus.

13. The system of claim 1, wherein said base unit is operatively connected to eight elevators.

14. The system of claim 13, wherein said elevators are located in a single building.

15. The system of claim 13, wherein said elevators are located in a plurality of buildings.

* * * * *